US006527355B1

(12) United States Patent
Yang et al.

(10) Patent No.: US 6,527,355 B1
(45) Date of Patent: Mar. 4, 2003

(54) METHOD AND APPARATUS FOR PREVENTING BANDING DEFECTS CAUSED BY DROP MASS VARIATIONS IN AN INK JET PRINTER

(75) Inventors: Qing Yang, Fairport, NY (US); Yonglin Xie, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/682,392

(22) Filed: Aug. 29, 2001

(51) Int. Cl.[7] ..... B41J 29/38

(52) U.S. Cl. ..... 347/14; 347/10; 347/11; 347/17; 347/60

(58) Field of Search ..... 347/14, 60, 9, 347/10, 11, 17

(56) References Cited

U.S. PATENT DOCUMENTS 5,861,895 A * 1/1999 Tajika et al. ..... 347/14
5,880,751 A * 3/1999 Nishikori et al. ..... 347/14
6,076,919 A * 6/2000 Shirota et al. ..... 347/60
6,309,051 B1 * 10/2001 Koitabashi et al. ..... 347/57
6,457,794 B1 * 10/2002 Tajika et al. ..... 347/11

* cited by examiner

*Primary Examiner*—John Barlow
*Assistant Examiner*—Lam Nguyen
(74) *Attorney, Agent, or Firm*—Oliff & Berridge, PLC

(57) ABSTRACT

A method and apparatus prevents banding defects caused by drop mass variations in an ink jet printer. The ink jet printer uses different pre-pulse sequences for drop ejection depending on print head temperature. Each of the different pre-pulse sequences is associated with a corresponding temperature range. Boundaries between adjacent temperature ranges are separated by critical temperatures. A determination is made as to whether a change in the print head temperature constitutes, or is part of, a temperature change that exceeds a predetermined threshold change amount, prior to determining whether to change the pre-pulse sequence.

22 Claims, 6 Drawing Sheets

300

302 304

| TEMPERATURE °C | PRE-PULSES | | | | | | | | | | MAIN |
|---|---|---|---|---|---|---|---|---|---|---|---|
| | ON | OFF | ON | OFF | ON | OFF | ON | OFF | ON | OFF | ON |
| Tc(1) = 25 | 0.250 | 0.625 | 0.125 | 0.625 | 0.250 | 0.625 | 0.125 | 0.625 | 0.250 | 0.625 | 2.375 |
| Tc(2) = 30 | | | | | 0.250 | 0.625 | 0.125 | 0.625 | 0.250 | 0.625 | 2.500 |
| Tc(3) = 35 | | | | | | | | | 0.250 | 0.625 | 2.625 |
| Tc(4) = 40 | | | | | | | | | | | 2.625 |
| Tc(5) = 45 | | | | | | | | | | | 2.625 |
| Tc(6) = 50 | | | | | | | | | | | 2.500 |
| Tc(7) = 55 | | | | | | | | | | | 2.375 |
| | | | | | | | | | | | |
| | | | | | | | | | | | |
| | | | | | | | | | | | |

FIG. 3

METHOD AND APPARATUS FOR PREVENTING BANDING DEFECTS CAUSED BY DROP MASS VARIATIONS IN AN INK JET PRINTER

BACKGROUND OF THE INVENTION

1. Field of Invention

This invention relates to ink jet printers, and more particularly to method and apparatus for preventing banding defects caused by pre-pulse sequence flip-flop due to temperature fluctuations around critical temperatures when printing in an ink jet printer.

2. Description of Related Art

Generally, a print head temperature fluctuates steadily while printing onto a print medium. As the temperature of the print head varies, the drop mass of an ink droplet fluctuates, which adversely affects the print quality. Conventionally, to reduce the effect of fluctuation in the mass of the ink droplet, a pre-pulse sequence is selectively varied as the print head temperature varies during a printing operation. As the temperature of the print head changes, a particular pre-pulse sequence associated within a particular temperature range is selected. By varying the pre-pulse sequence based on the temperature, fluctuations in the drop mass of the ink droplet can be minimized. In this technique, the boundaries between each temperature range are known as "critical temperatures." That is, each time the temperature crosses a critical temperature, the pre-pulse sequence is changed. In general, as the temperature rises across a critical temperature, a shorter pre-pulse sequence replaces a longer pre-pulse sequence. This transition causes a sudden drop in the drop mass. The inverse is true when the temperature drops across a critical temperature.

In one example, each temperature range is approximately 5° C., and thus the critical temperatures are provided in 5° C. increments (e.g., 25° C., 30° C., 35° C, etc.). Thus, a single pre-pulse sequence will be used between the consecutive critical temperatures. While this will result in a slight variation in drop size within each temperature image (e.g., as the temperature increases from 26° C. to 29° C.), the visual effect is minimal. However, this method does not work well when the temperature of the print head oscillates around a critical temperature.

In particular, small temperature oscillations across a critical temperature (e.g., 35° C.) cause one pre-pulse sequence to flip-flop with another pre-pulse sequence associated with a different temperature range, and thus causes frequent large changes in drop mass and objectionable banding. Factors that can cause temporary drops in the detected temperature, which may cause oscillation about a critical temperature include, for example: reducing the pre-pulse train (i.e., due to changing to a new pre-pulse sequence when the temperature rises across a critical temperature), a temporary reduction in print head power due to maintenance operations, and electrical noise associated with the temperature sensor.

SUMMARY OF THE INVENTION

The present invention addresses the problems set forth above. Aspects of this invention relate to method and apparatus for preventing banding defects caused by pre-pulse sequence flip-flop due to detected temperature oscillations around critical temperatures in an ink jet printer that uses different pre-pulse sequences depending on the detected print head temperature. Each of the pre-pulse sequences is associated with a corresponding temperature range, the boundaries between adjacent temperature ranges being separated by critical temperatures.

According to one aspect of the invention, rather than merely changing the pre-pulse sequence when the detected temperature crosses a critical temperature, a determination is made as to whether the change in temperature constitutes, or is part of, a temperature change that exceeds a predetermined threshold change amount, prior to determining whether to change the pre-pulse sequence. If the detected change constitutes, or is part of, a temperature change that exceeds the predetermined threshold change amount, then the pre-pulse sequence is permitted to change; otherwise, the pre-pulse sequence is not permitted to change (i.e., it is prohibited from changing). The predetermined threshold change amount functions as a temperature buffer. This temperature buffer can be used for decreases and/or increases in temperature.

In a preferred embodiment, the temperature buffer is used with decreases in temperature because it is temporary temperature decreases that are more prevalent.

BRIEF DESCRIPTION OF THE DRAWINGS

Various exemplary embodiments of the invention will be described in detail, with reference to the following figures in which:

FIG. 3 is an exemplary data structure for storing pre-pulse sequence patterns corresponding to temperatures;

DETAILED DESCRIPTION OF PREFERRED EMBODIMENTS

Figure 1:
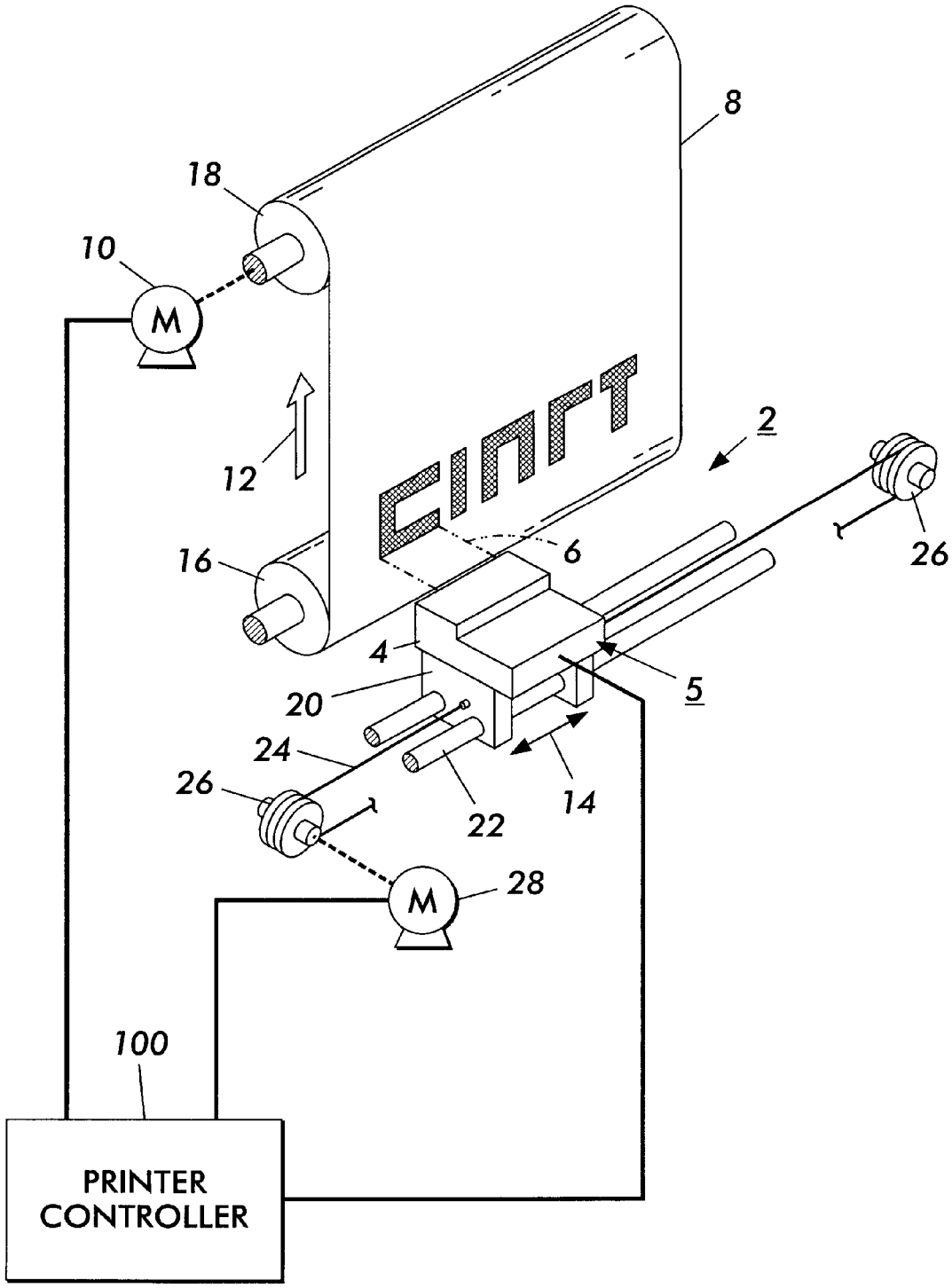
FIG. 1 is a schematic view of a printing system in accordance with an embodiment of the present invention.

FIG. 1 shows an exemplary carriage-type ink jet printing device 2. A vertically linear array of droplet producing channels is housed in the print head 4 of a reciprocal carriage assembly 5. Ink droplets 6 are propelled to a recording medium 8, such as a sheet of paper, that is stepped by a motor 10 a preselected distance (often equal to the size of the array) in a direction of arrow 12 each time the print head 4 traverses across the recording medium 8 in the directions indicated by arrow 14. The recording medium 8 can be stored on a supply roll 16 and stepped onto takeup roll 18 by stepper motor 10 or other structures, apparatus or devices well known to those of skill in the art.

The print head 4 is fixedly mounted on the support base 20, which is adapted for reciprocal movement using any well known structure, apparatus or device, such as two parallel guide rails 22. The reciprocal movement of the print head 4 may be achieved by a cable 24 and a pair of pulleys 26, one of which is powered by a reversible motor 28. The print head 4 is generally moved across the recording medium 8 perpendicularly to the direction in which the recording medium 8 is moved by the motor 10. Of course, other structures for reciprocating the carriage assembly 5 are possible.

The ink jet printing device 2 is operated under the control of a printer controller 100. The printer controller 100 transmits commands to the motors 10 and 28 and the print head 4 to produce an image on the image recording medium 8. Furthermore, the controller 100 receives information from the various components of the ink jet printing system 2. For example, the controller 100 receives measurements of the print head temperature from a temperature sensor or temperature controlled oscillator (TCO) located in print head 4.

Figure 2:
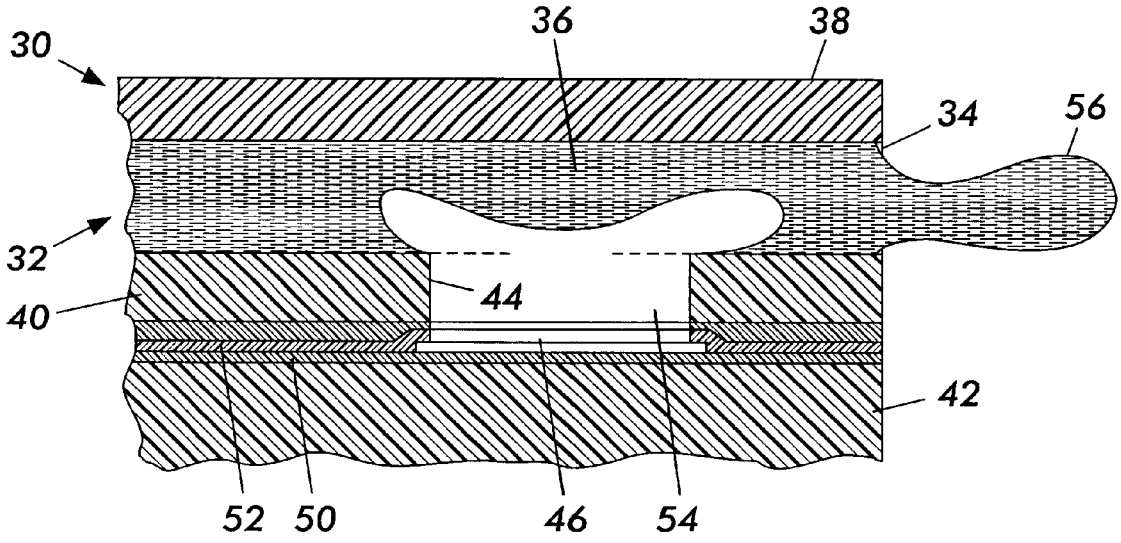
FIG. 2 is a cross-sectional view of a single ejector channel for an ink jet print head.

FIG. 2 shows one exemplary embodiment of an ink droplet emitter, or ejector 30, of the ink jet print head 4. The ink droplet ejector 30 is one of a large plurality of such emitters found in a typical ink jet print head. While FIG. 2 shows a side-shooter emitter, other emitters such as roof-shooter emitters may similarly be used with this invention. Typically, such emitters are sized and arranged in linear arrays of 300 to 600 emitters per inch, although other arrangements are known to one skilled in the art. A silicon member having a plurality of channels for ink droplet emission is known as a "die module" or "chip". Each die module typically comprises hundreds of emitters, spaced 300 or more to the inch. An ink jet print head may have one or more die modules extending the effective size of the array. In print heads with multiple die modules, each die module may include its own ink supply manifold, or multiple die modules may share a common ink supply manifold.

Each emitter 30 includes a capillary channel 32 terminating in an orifice or nozzle 34. The channel 32 holds a quantity of ink 36 maintained within the capillary channel 32 until such time as a droplet of ink is to be emitted. Each capillary channel 32 is connected to a supply of ink from an ink supply manifold (not shown). The upper substrate 38 abuts a thick film layer 40, which in turn abuts a lower substrate 42.

Sandwiched between the thick-film layer 40 and the lower substrate 42 are electrical heating elements 46 used to eject ink droplets from the capillary channel 32 in a well-known manner. The heating element 46 may be located within a recess 44 formed by an opening in the thick film layer 40. The heating element 46 is directly or indirectly electrically connected to an addressing electrode 50. Each of the ejectors 30 in the print head 4 may have its own heating element 46 and an individual addressing electrode 50. The addressing electrode 50 may be protected by a passivation layer 52. Each addressing electrode 50 and corresponding heating element 46 may be selectively controlled by control circuitry. Other embodiments of the ink jet print head are well known to one skilled in the art and are also within the scope of this invention.

As is well known in the art, when a print pulse, i.e., the drive pulse, firing pulse or main pulse, is applied to the addressing electrode 50, the heating element 46 is energized. The print pulse is a signal that is of a sufficient magnitude and/or duration so that the heat from the resistive heating element 46 will cause the liquid ink immediately adjacent to the heating element 46 to vaporize, creating a bubble 54 of vaporized ink. The force of the expanding bubble 54 ejects an inkdroplet 56, which includes a main droplet and might include smaller satellite drops, from the nozzle 34 onto the surface of the recording medium 8.

Furthermore, under the control of the controller 100, thermal ink jet print heads may apply a plurality of pre-pulses to the heating element 46 prior to ejecting each ink droplet 56. Typically, one or more pre-pulses may be applied by the heating element 46 prior to a print pulse in order to warm the ink prior to ejection. The amount and timing of the pre-pulse varies as a function of the detected temperature of the print head, which is related to the temperature of the ink therein.

FIG. 3 shows an exemplary pre-pulse table 300 having an ink temperature in a field 302 and a corresponding pre-pulse sequence, or pulse train, in a field 304. The pre-pulse sequence includes several narrow pre-pulses followed by a wide main pulse (or print pulse) that is used to eject an ink droplet 56. In this exemplary embodiment, the critical temperatures Tc(n) are defined at 5° C. increments beginning at 25° C. and finishing at 55° C., e.g., Tc(1)=25° C., Tc(2)=30° C., Tc(3)=35° C., Tc(4)=40° C., Tc(5)=45° C., Tc(6)=50° C. and Tc(7)=55° C. The critical temperatures can be defined at any number of increments, including but not limited to increments of 10° C., 7.5° C., 5° C., 2.5° C., etc. It is not necessary for the increments to be the same between all of the critical temperatures (e.g., some could be separated by 5° C., while others are separated by a different amount).

As shown in FIG. 3, for an ink temperature of 40° C. and higher, the pre-pulses are absent, while at 25° C. there is an extended number of pre-pulses present. For temperatures above 40° C., the adjustment (if any) is contained in the main (ejecting) pulse itself since less heat is necessary to nucleate the vapor bubble 54. In this regard, the main pulse is considered to be a part of (in some instances, all of) the pre-pulse sequence. The pre-pulses may be used to raise the temperature of the ink adjacent the heating element 46, and additionally may be used to control the volume of ink droplet 56. The pre-pulses do not contain enough energy to cause the ink droplet 56 to be emitted before the main (last) pulse. Subsequent to the pre-pulses, the main pulse is applied to the heating element 46. As described above, the main pulse causes the ink droplet 56 to be ejected onto the image receiving member 8.

If the detected temperature is determined to be below the lowermost critical temperature in the operating range (e.g., 25° C.) or above the highest critical temperature in the operating range (e.g., 55° C.), then fluctuations in the drop mass can be problematic. The highest critical temperature and lowermost critical temperature can be varied to within acceptable temperatures allowable by the construction and composition of the print head and the ink. Below 25° C., the controller 100 is used to reduce the drop mass variation by emitting small pulses that heat up the ink without substantially generating a vapor bubble which would cause an ink drop to be ejected from the ink drop ejector 36. This operation will be referred to herein as "prewarming." Alternatively, above 55° C., the controller 100 is used to reduce the drop mass variation by slowing down or terminating the printing until the temperature is brought back down to within the operating temperature. This operation will be referred to herein as "heatsmart." Prewarming and heatsmart are not critical to the invention, and therefore will not be described further.

Figure 4:
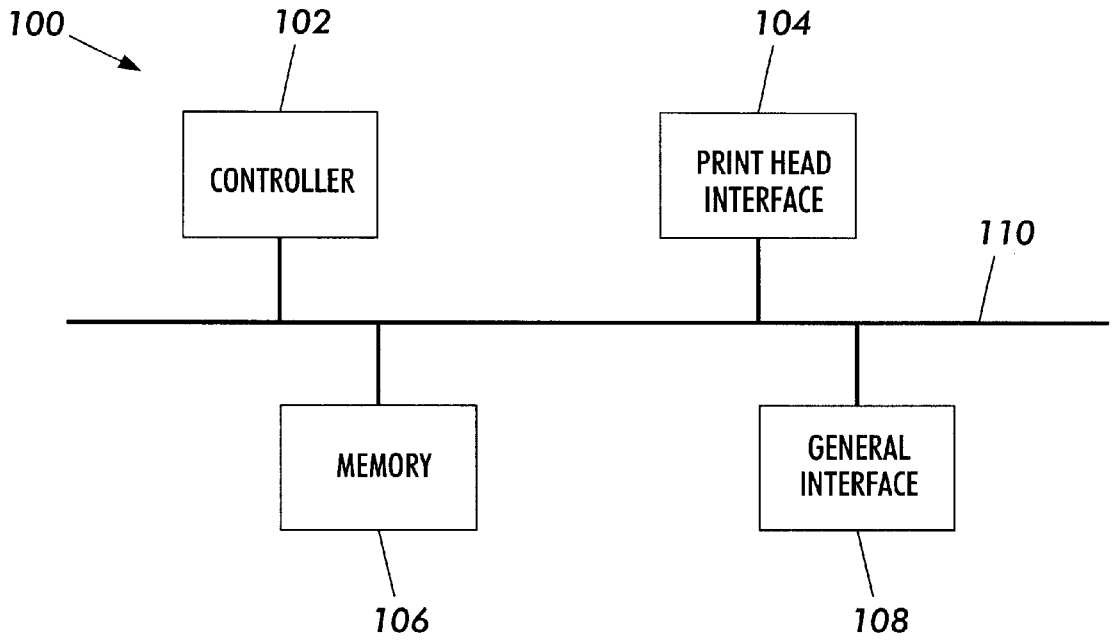
FIG. 4 is an exemplary block diagram of the print controller of FIG. 1.

FIG. 4 is a block diagram of one exemplary embodiment of the controller 100. The controller 100 includes a controller 102, a print head interface 104, a memory 106, and a general interface 108, connected together by a control/signal bus 110. In operation, the controller 102 communicates with the print head 4 and the printer motors 10 and 28 through the print head interface 104 and the general interface 108, respectively, to create an image from image data received from a data source (not shown).

Figure 5:
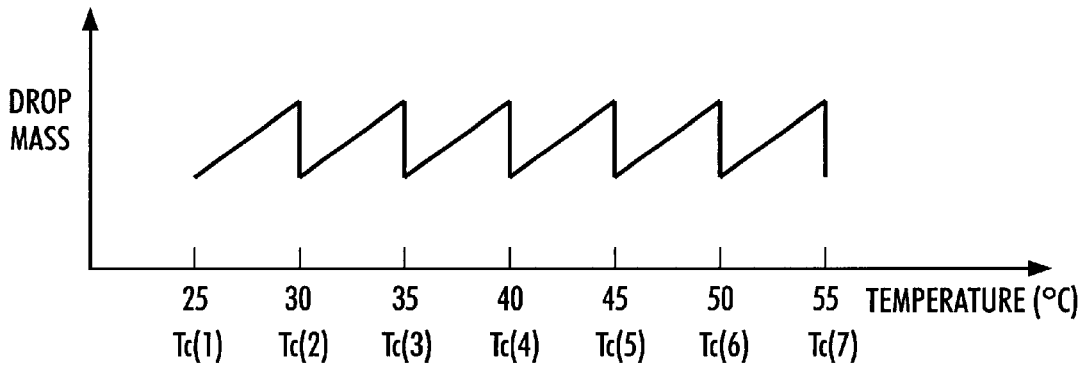
FIG. 5 is a graphical representation of the drop mass as a function of temperature.

FIG. 5 is a graphical representation illustrating the drop mass as a function of the temperature of the ink. A temperature sensor on the die module of the print head 4 is used to detect the print head temperature (and, thus, the ink temperature)right before each swath is ejected. The temperature detected by the temperature sensor determines which pre-pulse sequence will be used for the next swath. Between any two neighboring critical temperatures Tc(n) the pre-pulse sequence is kept constant. Thus, the drop mass varies between a lower critical temperature and a higher critical temperature in an interval between two adjacent critical temperatures. (For example, the drop mass increases between 30° C. and 35° C. because the same pre-pulse sequence is used therein.) As the temperature rises across a critical temperature, a shorter pre-pulse sequence replaces the previous longer pre-pulse sequence. See, e.g., FIG. 3. This transition causes a sudden drop in the mass of the drop. The inverse is true for decreases in the temperature.

Figure 6:
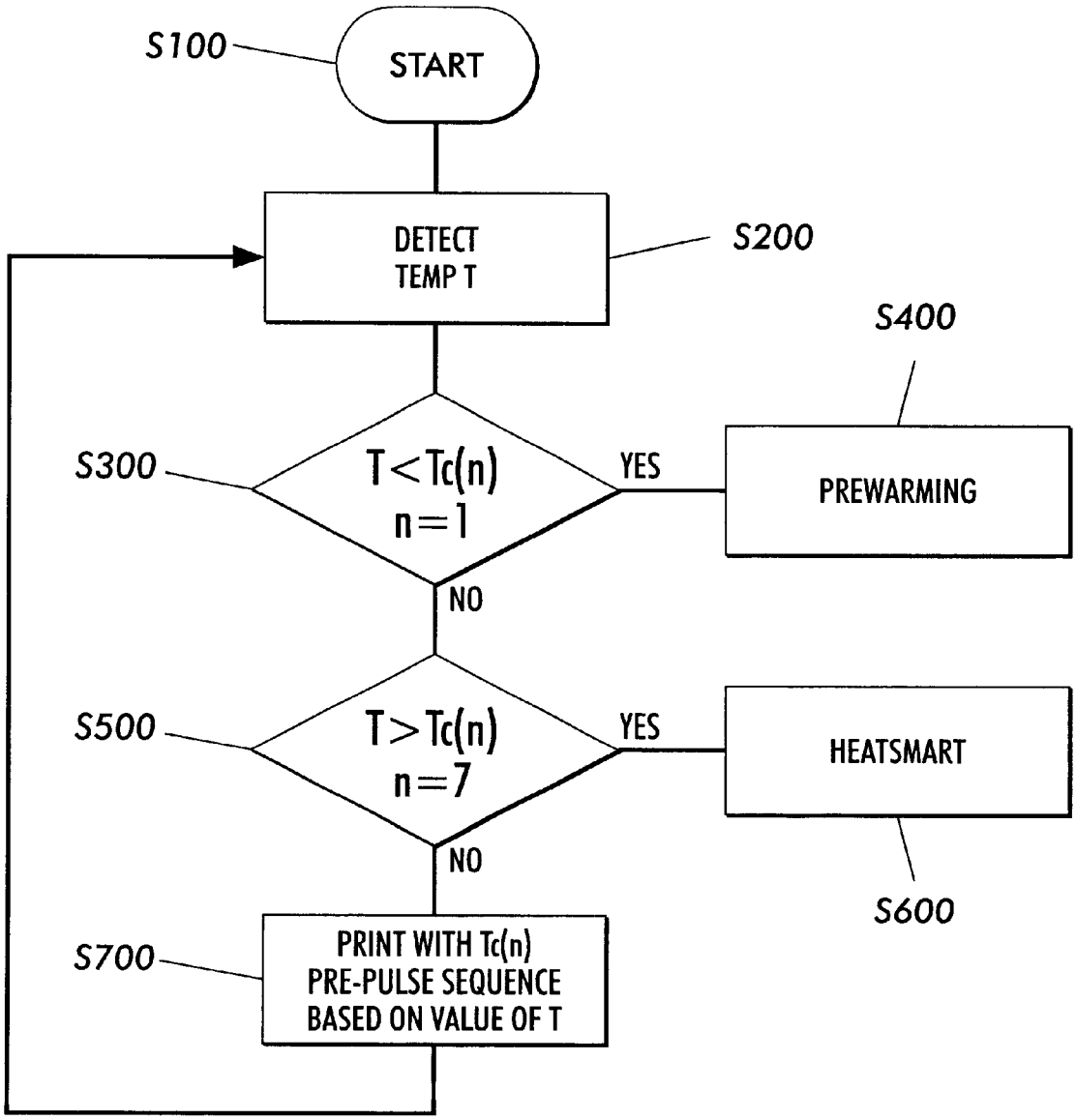
FIG. 6 is a flowchart of a conventional control routine for controlling pre-pulse sequences.

FIG. 6 is a flowchart outlining a conventional control routine for selecting a pre-pulse sequence from a series of pre-pulse sequences in a print operating range, as shown in FIG. 3. In step S100, the control routine begins. The control routine continues to step S200.

In step S200, the temperature T is detected by the temperature sensor. The control routine continues to step S300.

In step S300, the control routine determines whether the following condition is satisfied, $T<Tc(n)$, where $n=1$. That is, whether the detected temperature T is less than the value Tc(1), (in this example, 25° C.). If the temperature is less than 25° C., the control routine jumps to step S400. Otherwise, the control routine continues to step S500. In step S400, "prewarming" is performed.

In step S500, the control routine determines whether the following condition is satisfied, $T>Tc(n)$, where $n=7$ (in this example, 55° C.). If the temperature is greater than 55° C., the control routine jumps to step S600. Otherwise, the control routine jumps to step S700. In step S600, "heatsmart" is performed.

In step S700, the control routine prints using a pre-pulse sequence associated with Tc(n) based on value of T such that $Tc(n) \leqq T$ and $T<Tc(n+1)$. In other words, the pre-pulse sequence associated with the detected temperature is used. The control routine then returns to step S200.

The conventional control routine for selecting a pre-pulse sequence as described above, selects the appropriate pre-pulse sequence merely based upon the detected temperature. As the temperature increases between two critical temperatures (e.g., between 25° C. and 30° C.), the drop mass gradually increases. The inverse is true as the temperature drops between two adjacent critical temperatures. As the temperature rises across a critical temperature (e.g., as the temperature rises from 29° C. to 31° C., thus crossing the 30° C. critical temperature), a shorter pre-pulse sequence replaces a longer pre-pulse sequence. The inverse is true as the temperature decreases across a critical temperature. With respect to an increase, this transition causes a sudden drop in the drop mass as can be appreciated from FIG. 5. The opposite is true when the temperature decreases through a critical temperature.

These sharp changes in the drop mass do not, per se, adversely affect the quality of the produced image.

However, the detected temperature can oscillate slightly due to various factors such as, for example, electrical noise in the temperature detector. Another source of fluctuations is the performance of print head maintenance operations. Such operations would generally cause the detected temperature to decrease slightly for a short time period during which the maintenance operation is performed. The print head operation would then return to its previous state once printing resumes, assuming that the content of the image has not changed substantially. Such temporary (or small) fluctuations in the detected temperature have a very minor effect on the image quality if the temperature remains between two critical temperatures (e.g., if the temperature remains between 30° C. and 35° C.). In such a situation, the same pre-pulse sequence would be used for the varying detected temperatures.

However, if the temperature oscillates in the vicinity of a critical temperature, such that it oscillates between being below the critical temperature and being above the critical temperature, the routine illustrated in FIG. 6 would result in the pre-pulse sequence flip-flopping between the sequence to be used below that critical temperature and the sequence to be used above that critical temperature. Such oscillation results in the occurrence of banding in the resulting image, which is visually noticeable.

Another cause of such banding (i.e., another cause of the detected temperature oscillating in the vicinity of a critical temperature) occurs when the pre-pulse sequence changes from one sequence to another. For example, as the temperature rises from 29° C. to 31° C., the pulse sequence will change from a longer sequence to a shorter sequence. The changing to the shorter sequence will cause the temperature to temporarily drop. If this temporary drop in temperature is large enough (e.g., if the temperature drops below 30° C.), the previously used (i.e., longer) pulse-sequence will again be used. Assuming that the content of the image was causing the temperature to increase (e.g., the image was a high density image) the temperature will continue to increase and then again pass the critical temperature (30° C. in this example). This will cause the pre-pulse sequence to change again, resulting in the above-described banding. This problem can be considered to be a type of hystereses effect that occurs when the pre-pulse sequence is changed.

It is an aspect of this invention to address the above-described phenomenon that leads to banding. The invention does not merely change the pre-pulse sequence when the detected temperature crosses a critical temperature. Rather, a determination is made as to whether a detected change in temperature constitutes, or is part of, a temperature change that exceeds a predetermined threshold change amount ($\Delta T$), prior to determining whether to change the pre-pulse sequence. If the detected change constitutes, or is part of, a temperature change that exceeds the predetermined threshold change amount, then the pre-pulse sequence is permitted to change. Otherwise, the pre-pulse sequence is not permitted to change. The predetermined threshold change amount functions as a temperature buffer. This temperature buffer can be used for decreases and/or increases in the temperature.

Figure 7:
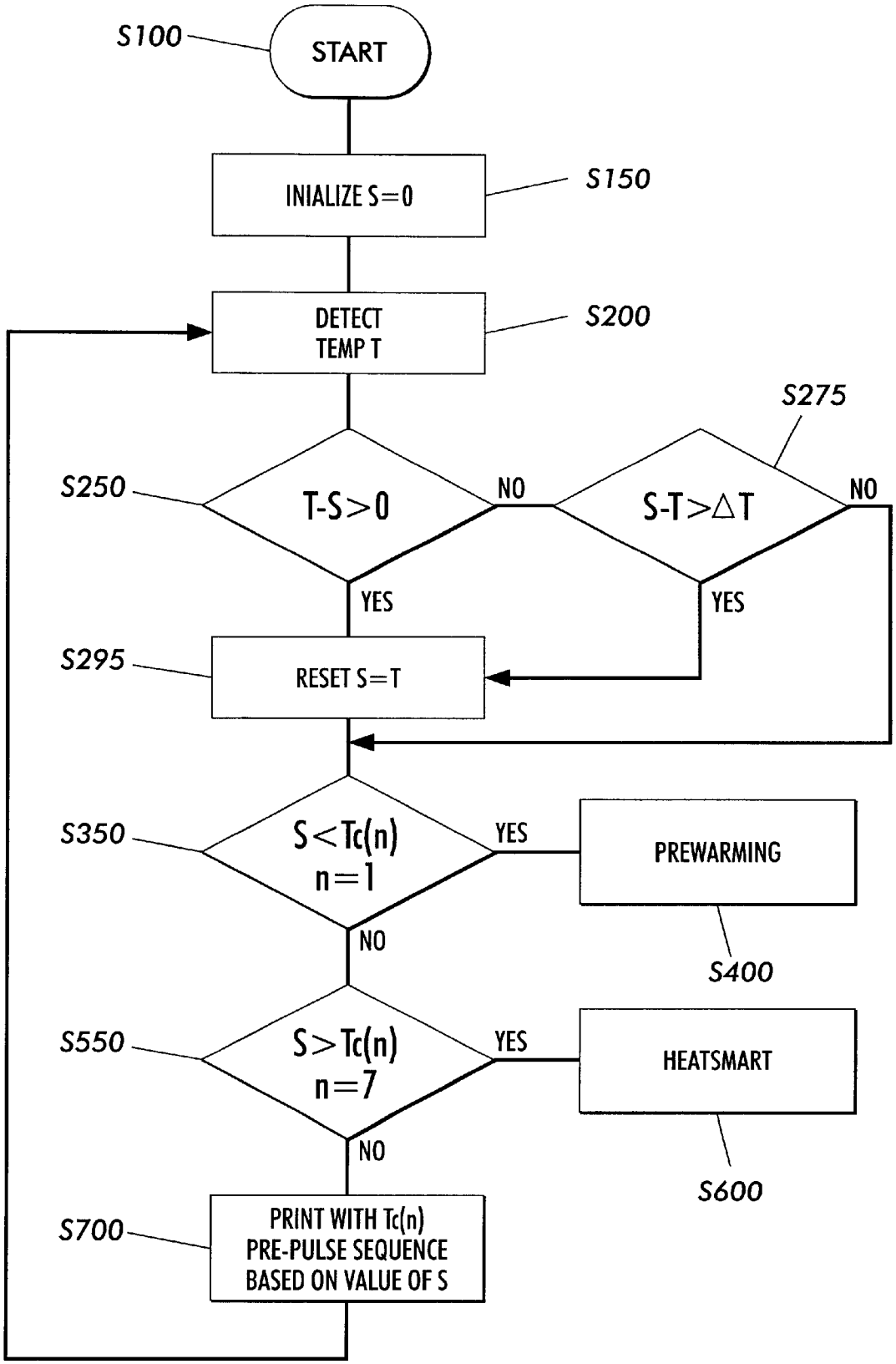
FIG. 7 is a flowchart of an exemplary process that prevents pre-pulse related banding according to one exemplary embodiment of the present invention.

FIG. 7 is a flowchart outlining an exemplary embodiment of a control routine for preventing pre-pulse related banding by incorporating the temperature buffer $\Delta T$. Like reference numbers are similar to the reference numerals used in FIG. 6. In step S100, the control routine begins. The control routine continues to step S150.

In step S150, a value S is initialized and set equal to "0". The control routine continues to step S200.

In step S200, the temperature sensor detects the temperature T. The control routine continues to step S250.

In step S250, the control routine determines whether the following condition is satisfied, $T-S>0$. That is, whether subtracting the value S from the detected temperature T is greater than 0. If so, the control routine continues to step S295. Otherwise, the control routine jumps to step S275. In step S295, the control routine resets S=T and then continues to step S350.

In step S275, the control routine determines whether the following condition is satisfied, $S-T>\Delta T$. That is, whether subtracting the detected temperature T from the value S is greater than $\Delta T$. As noted above, $\Delta T$ is the temperature buffer, i.e., a predetermined threshold change amount. If so, the control routine continues to step S295. Otherwise, the control routine jumps to step S350.

In step S350, the control routine determines whether the following condition is satisfied, $S<T(n)$, where n=1. That is, whether the value S is less than the value T(1), in this example, 25° C. If so, the control routine jumps to step S400. Otherwise, the control routine continues to step S550. In step S400, "prewarming" is performed as described previously.

In step S550, the control routine determines whether the following condition is satisfied, $S>Tc(n)$, where n=7. That is, whether the value S is greater than the value Tc (7), in this example, 55° C. If so, the control routine jumps to step S600. Otherwise, the control routine jumps to step S700. In step S600, "heatsmart" is performed, as described previously.

In step S700, the control routine prints with the pre-pulse sequence designated by Tc(n) based upon the value of S such that $Tc(n)\leqq S$ and $S<Tc(n+1)$. The control routine then returns to step S200.

The embodiment illustrated by the FIG. 7 flowchart applies the temperature buffer $\Delta T$ to decreases in temperature. It will treat increases in temperature the same as the FIG. 6 flowchart. Thus, as a temperature increases across a threshold (the output of step S250 is affirmative), the value of S will be reset to the current temperature (T), and that temperature will be used in step S700 (as long as it is between 25° C. and 55° C., i.e., as long as prewarming or heatsmart is not required). However, if a temperature decrease occurs, the result of step S250 is negative, and the system will continue to use some previous temperature (i.e., the value of S) until the detected temperature decreases by a certain amount ($\Delta T$) below that previously detected temperature S. At that point (an affirmative result of step S275), the value of S will be reset to the current temperature (T), and then that value will be used to determine the pre-pulse sequence in step S700.

The inventors have found that a procedures as illustrated, for example, in FIG. 7 will prevent undesired banding from occurring. If, for some reason, the temperature decreases drastically (by at least $\Delta T$), the pre-pulse sequence also will change quickly. On the other hand, if there is a gradual decrease in the detected temperature, then the change in the pre-pulse sequence may be delayed from what would occur in connection with the FIG. 6 flowchart.

The value of $\Delta T$ can be optimized by experiment. In an arrangement in which the critical temperatures are separated by 5° C. increments, it has been found that using a value of 2° C. for $\Delta T$ is effective for preventing banding. Of course, it is possible to use other values for $\Delta T$. In addition, it may be desirable to use a value for $\Delta T$ that varies depending upon the critical temperature.

The embodiment illustrated in FIG. 7 uses the temperature buffer only in connection with decreases in the detected temperature. However, the FIG. 7 embodiment could be modified for use with increases in temperature, for example, by changing the greater than (>) symbols in steps S250 and S275 to less than (<) symbols. It also is possible to provide an arrangement in which the temperature buffer is used both for temperature increases and decreases.

In the illustrated embodiment, the controller 102 is implemented as a programmed general purpose computer. It will be appreciated by those skilled in the art that the controller can be implemented using a single special purpose integrated circuit (e.g., ASIC) having a main or central processor section for overall, system-level control, and separate sections dedicated to performing various different specific computations, functions and other processes under control of the central processor section. The controller can be a plurality of separate dedicated or programmable integrated or other electronic circuits or devices (e.g., hardwired electronic or logic circuits such as discrete element circuits, or programmable logic devices such as PLDs, PLAs, PALs or the like). The controller can be implemented using a suitably programmed general purpose computer, e.g., a microprocessor, microcontroller or other processor device (CPU or MPU), either alone or in conjunction with one or more peripheral (e.g., integrated circuit) data and signal processing devices. In general, any device or assembly of devices on which a finite state machine capable of implementing the procedures described herein can be used as the controller. A distributed processing architecture can be used for maximum data/signal processing capability and speed.

While the invention has been described with reference to preferred embodiments thereof, it is to be understood that the invention is not limited to the preferred embodiments or constructions. To the contrary, the invention is intended to cover various modifications and equivalent arrangements. In addition, while the various elements of the preferred embodiments are shown in various combinations and configurations, which are exemplary, other combinations and configurations, including more, less or only a single element, are also within the spirit and scope of the invention.

What is claimed is:

1. An ink jet printer that uses different pre-pulse sequences for drop ejection depending on an actual print head temperature, each of the different pre-pulse sequences is associated with a corresponding temperature range, boundaries between adjacent temperature ranges being separated by critical temperatures, the inkjet printer comprising a controller that:

determines whether a change in the actual print head temperature constitutes, or is part of, a temperature change that exceeds a predetermined change amount, prior to determining whether to change the pre-pulse sequence;

wherein the controller permits the pre-pulse to be changed if the actual print head temperature has passed through one of the critical temperatures and if the change in the print head temperature is determined to constitute, or to be part of, a temperature change that exceeds the predetermined threshold change amount.

2. The ink jet printer according to claim 1, wherein the controller does not permit the pre-pulse sequence to be changed if the actual print head temperature has passed through one of the critical temperatures, if the change in the actual print head temperature is determined not to constitute, or not to be part of, a temperature change that exceeds the predetermined threshold change amount.

3. The ink jet printer according to claim 1, wherein the controller does not permit the pre-pulse sequence to be changed if the actual print head temperature has passed through one of the critical temperatures, if the change in the actual print head temperature is determined not to constitute, or not to be part of, a temperature change that exceeds the predetermined threshold change amount.

4. The ink jet printer according to claim 1, wherein the determination as to whether the change in the actual print head temperature is determined to constitute, or to be part of, a temperature change that exceeds the predetermine threshold change amount only is performed when the temperature change is a temperature decrease.

5. The ink jet printer according to claim 1, wherein each of the pre-pulse sequences includes a main pulse.

6. An ink jet printer comprising:

a memory that stores a plurality of different pre-pulse sequences for drop ejection, each of the different pre-pulse sequences is associated with a different temperature range, boundaries between adjacent temperature ranges being separated by cricital temperatures;

a temperature detector that detects an actual print head temperature related to ink that is to be ejected by the printer; and a controller that determines whether to use the pre-pulse sequence asociated with the detected temperature by determining whether the actual print head temperature has passed through one of the critical temperatures and if the amount of change in print head temperature exceeds a predetermined threshold change amount.

7. The ink jet printer according to claim 6, wherein the controller uses the pre-pulse sequence associated with the detected temperature if the actual print head temperature has changed by an amount that exceeds the predetermined threshold change amount.

8. The ink jet printer according to claim 7, wherein the controller does not uses the pre-pulse sequence associated with the detected temperature if the actual print head temperature has changed by an amount that does not exceed the predetermined threshold change amount.

9. The ink jet printer according to claim 6, wherein the controller does not uses the pre-pulse sequence associated with the detected temperature if the actual print head temperature has changed by an amount that does not exceed the predetermined threshold change amount.

10. The ink jet printer according to claim 6, wherein the controller uses the pre-pulse sequence associated with the detected temperature when the temperature is increasing, regardless of the amount by which the actual print head temperature has changed, and when the temperature is decreasing, the controller determines whether to use the pre-pulse sequence associated with the detected temperature by determining whether the actual print head temperature has changed by an amount that exceeds the predetermined threshold change amount.

11. The ink jet printer according to claim 6, wherein each of the pre-pulse sequences includes a main pulse.

12. An ink jet printing method in which different pre-pulse sequences are used for drop ejection depending on an actual print head temperature, each of the different pre-pulse sequences is associated with a corresponding temperature range, boundaries between adjacent temperature ranges being separated by critical temperatures, the method comprising the step of determining whether a change in the actual print head temperature constitutes, or is part of, a temperature change that exceeds a predetermined threshold change amount, prior to determining whether to change the pre-pulse sequence, permitting the pre-pulse sequence to be changed if the actual print head temperature has passed through one of the critical temperatures and if the change in the actual print head temperature is determined to constitute, or to be part of, a temperature change that exceeds the predetermined the threshold change amount.

13. The method according to claim 12, further comprising prohibiting the pre-pulse sequence from being changed if the actual print head temperature has passed through one of the critical temperatures, if the change in the actual print head temperature is determined not to constitute, or not to be part of, a temperature change that exceeds the predetermined threshold change amount.

14. The method according to claim 12, further comprising prohibiting the pre-pulse sequence from being changed if the actual print head temperature has passed through one of the critical temperatures, if the change in the actual print head temperature is determined not to constitute, or not to be part of, a temperature change that exceeds the predetermined threshold change amount.

15. The method according to claim 12, wherein the determination as to whether the change in the actual print head temperature is determined to constitute, or to be part of, a temperature change that exceeds the predetermined threshold change amount only is performed when the temperature change is a temperature decrease.

16. The method according to claim 12, wherein each of the pre-pulse sequences includes a main pulse.

17. An ink jet printing method in which a memory stores a plurality of different pre-pulse sequences for drop ejection, each of the different pre-pulse sequences is associated with a different temperature range, boundries between adjacent temperature ranges being seperated by critical temperatures, the method comprising the steps of detecting a temperature related to ink that is to be ejected; and determining whether to use the pre-pulse sequence associated with the detected temperature by determining whether an actual print head temperature has passed through one of the critical temperatures and if the amount of change exceeds a predetermined threshold change amount.

18. The method according to claim 17, further comprising using the pre-pulse sequence associated with the detected temperature if the actual print head temperature has changed by an amount that exceeds the predetermined threshold change amount.

19. The method according to claim 18, further comprising prohibiting use of the pre-pulse sequence associated with the detected temperature if the actual print head temperature has changed by an amount that does not exceed the predetermined threshold change amount.

20. The method according to claim 17, further comprising prohibiting use of the pre-pulse sequence associated with the detected temperature if the actual print head temperature has changed by an amount that does not exceed the predetermined threshold change amount.

21. The method according to claim 17, wherein the pre-pulse sequence associated with the detected temperature is used regardless of the amount by which the actual print head temperature has changed when the temperature is increasing, and when the temperature is decreasing, the step of determining whether to use the pre-pulse sequence associated with the detected temperature by determining whether the actual print head temperature has changed by an amount that exceeds the predetermined threshold change amount is performed.

22. The method according to claim 17, wherein each of the pre-pulse sequences includes a main pulse.

* * * * *